United States Patent [19]

Gomoll et al.

[11] Patent Number: 4,720,200

[45] Date of Patent: Jan. 19, 1988

[54] ADJUSTING THE DISTANCE OF A PRINT HEAD FROM A PLATEN

[75] Inventors: Guenter Gomoll, Nersingen/Leibi; Wolfgang Hauslaib, Langenau; Gustav Frank, Neu-Ulm/Pfuhl, all of Fed. Rep. of Germany

[73] Assignee: Mannesmann AG, Duesseldorf, Fed. Rep. of Germany

[21] Appl. No.: 22,980

[22] Filed: Mar. 6, 1987

[30] Foreign Application Priority Data

Mar. 11, 1986 [DE] Fed. Rep. of Germany ..... 3608001

[51] Int. Cl.[4] ..... B41J 11/20

[52] U.S. Cl. ..... 400/59; 400/56

[58] Field of Search ..... 400/55–57, 400/59, 53, 352, 355

[56] References Cited

U.S. PATENT DOCUMENTS

| | | | |
|---|---|---|---|
| 4,023,662 | 5/1977 | Perucca | 400/59 X |
| 4,086,997 | 5/1978 | Wu | 400/59 X |
| 4,178,106 | 12/1979 | Mailer | 400/59 X |
| 4,189,244 | 2/1980 | Harrison | 400/59 X |
| 4,497,588 | 2/1985 | Volke | 400/59 X |
| 4,609,294 | 9/1986 | Gomoll | 400/59 |
| 4,652,153 | 3/1987 | Kotsuzumi | 400/59 X |

FOREIGN PATENT DOCUMENTS

| | | | |
|---|---|---|---|
| 49286 | 5/1981 | Japan | 400/59 |
| 117677 | 9/1981 | Japan | 400/56 |
| 126180 | 7/1983 | Japan | 400/59 |
| 6490 | 1/1985 | Japan | 400/59 |
| 154091 | 8/1985 | Japan | 400/59 |

*Primary Examiner*—Paul T. Sewell

*Attorney, Agent, or Firm*—Ralf H. Siegemund

[57] ABSTRACT

The print head is mounted on a carriage which, in turn, rides on a round bar which is transversely adjustable towards and away from the parallel running platen. The round bar rolls in horizontal oblong slots in side walls of the frame and has short, drum-shaped cams eccentrically connected to its ends, the cams being coaxial to each other and are held individually in abutment with reference surfaces that are individually adjustable on these side walls towards true parallelism; an adjusting lever is affixed to a third cam on the bar, and is coaxial to the two other cams, which lever is latchable in positions to thereby hold adjusted distances of the print head from the platen.

5 Claims, 6 Drawing Figures

ADJUSTING THE DISTANCE OF A PRINT HEAD FROM A PLATEN

BACKGROUND OF THE INVENTION

The present invention relates to the adjustment of the distance and spacing between the print head and the platen in a printer, particularly a matrix printer, wherein the print head proper is mounted on a carriage which, in turn, runs on a rail system including, particularly a pair of shafts or round bars, whereby one of the bars is being provided as a rail for running the print head carriage in the horizontal along the platen while the other bar runs and holds the carriage in the vertical, but permits movement of the carriage towards and away from the platen, whereby the first bar itself is adjustable in some fashion transverse to its extension, for varying the distance between that bar and the carriage on it and the platen.

Eccentric cam-like devices are used for purposes of adjusting the spacing between the print head and the platen, which feature permits the operating personnel to adjust the distance between the print head proper and the paper running through the printer on the platen so as to adjust basically the appearance of the printed characters. If multiple layers of paper are fed through for purposes of producing a plurality of copies such adjustment may be advisable in order to adapt the printer to specific types of paper or the like. Such adjustment however is destroyed, for example, when the ribbon has to be changed and a new ink ribbon cartridge has to be inserted or if the printer is used subsequently with a different type of print medium, differently thick paper, a different number of copies or the like. Also, the threading-in of the new print medium, particularly in case of an endless sheet, may often require some retraction of the print head so that in each case a new adjustment of the print head is necessary. Moreover, during extensive use of the printer it has to be observed that in the case of a matrix printer the print needles exhibit certain wear. In such a situation, a readjustment of the print head is necessary. This will be particularly true if for reason of excessive wear the needles, or the print head as a whole, are to be exchanged. This way, the head does not just have to be receded from the platen but has to be removed entirely. It is clear, therefore, that one cannot possibly rely on some initial optimization in adjusting the distance between the print head and the platen and/or the print medium but frequently situations arise in which a readjustment is necessary.

Eccentric cam devices working for adjusting the distance between the print head and the platen are shown, e.g. in U.S. Pat. No. 4,178,106. It has to be stated, however, that this particular arrangement is meaningful only for a platen which is non-round, i.e. has a flat printing surface. This is the element 9 in that patent. In addition, however, the adjusting device of that patent is insufficient, particularly concerning latching in some form of the adjusting lever to a null position, or null readjustment or adjustment to a null position, is rather imprecise. Moreover, the eccentric adjustment devices of that patent seem to be inadequately guided as far as the adjustment proper is concerned.

A somewhat more precise guiding structure is disclosed in U.S. Pat. No. 4,609,294, corresponding to German printed patent application No. 30 14 823. Herein, a particular frame is proposed being linearly guided within a printer housing. This frame is adjustable towards and away from the platen. The structure disclosed in this patent requires, in addition, a device for resting and latching the position as between the frame and the printer housing. Thus, the latter patent avoids the problems of imprecise guiding of the adjusting structure, but is, however, encumbered by a high cost aspect which, for economic reasons, is not always justifiable.

Independently from the foregoing, the German utility model (petty patent) Pat. No. 7140524, proposes that the print head is not adjustable but the platen itself is. On each of the two ends a separate adjustment device is provided. This particular printer then includes essentially three movable but interconnected groups of elements. There is, first, a pivotable holder, second, a lever element which responds to this adjustment movement, and, third, a fine or high precision coupling element. Therefore, there is a multiple of parts, all being adjustable which means that the tolerances inherent in each of these components compound additively. This results in inaccuracies between the various parts rendering the adjustment and the restorability of the particular adjustment position rather imprecise. Particularly the parallelity of the adjusting movement of the two devices at the two ends of the printing platen drum is subject to differences based on these tolerances.

DESCRIPTION OF THE INVENTION

It is an object of the present invention to provide a new and improved device and structure for adjusting the distance between a print head and a platen.

It is a particular object of the present invention to provide a new adjusting device that permits adjustment of the print head spacing from the platen, the print head being assumed to be mounted on a carriage which, in turn, rides on a rail structure, such as a bar.

It is another object of the present invention to improve the adjustability of a print head vis-a-vis a platen over prior art devices and towards simplification, particularly for avoiding the compounding of tolerances so as to achieve a higher degree of accuracy, as far as the null position is concerned. Also, the parallelism is to be improved.

It is a specific object of the invention to improve structures for adjusting the distance between a platen and a print head which is mounted on a carriage which rides on a bar having eccentric cams at its end for adjusting the spacing of the bar from the platen.

In accordance with the preferred embodiment of the present invention, it is suggested to supplement the two eccentric cam devices for a print head carriage rail bar, as per the specific object, by providing a third eccentric cam which agrees, as far as the eccentricity is concerned, in terms of amplitude and angular position with the other two eccentric cams. The rail bar is held and received by horizontal slots in the side walls of the printer frame and the two eccentric cams which provide for the principal adjustments, are resiliently held against reference surfaces defined by plates which in turn are adjustably mounted on the side walls right at the slots.

This particular arrangement establishes basically a single piece rail bar with three eccentric cams. They are manufactured at the requisite degree of accuracy, particularly as far as the dimensions are concerned which defines the eccentricity. In addition, there is an improved parallelism owing to the adjustment through an adjustable reference surface. The initial adjustment can be carried out in an optimizing fashion by means of an adjustment lever on the third eccentric cam, and includes parallel positioning of the reference surfaces. Subsequent changes ensure parallelism owing to the formation and use of the reference surface whereby a permanent abutment with respect to these surfaces are maintainable with relative ease and through single springs.

From a different point of view in accordance with the preferred embodiment of the present invention, a device for adjusting the spacing between a print head mounted on a carriage riding on a rail bar, and a print platen along which the print head travels is suggested under utilization of a conventional printer frame, in which the platen and the rail bar are mounted in the general sense, and the frame has two side structure. This adjusting device, specifically, includes that bar traversing the carriage and causing the carriage to move forward and away from the platen as the shaft moves bi-directionally, transversely to its extension. A first and a second cam are mounted to or otherwise connected to opposite ends of the bar, they have similarly oriented eccentricities in terms of value and maximum eccentric extension as well as in terms of orientation. There are two adjustably positioned plates mounted to the side wall structures each having a reference surface. These plates are adjustable for purposes of initial set up and calibration whereby the two reference surfaces have to have a definite relation to each other, preferably they are co-planar. These plates are mounted in the vicinity of the aforementioned cam means and springs are provided for urging these two eccentric cams against the reference surface of the plates. A third cam extends outwardly from the shaft with an eccentricity which is oriented to the first mentioned two cam means, and a latchable handle is mounted on that additional cam such that the angular disposition of that handle is a precise indicator of the position of the two cam means and thereby establishes definitely an indication of the spacing of the bar from the platen. Finally, apertures or slots are provided in the side walls for horizontally guiding the bar and its movement towards and away from the platen upon pivoting of the lever and turning of all of the eccentric cams. The angle should preferably be latchable in a plurality of different positions. The plates will cooperate with fastening and indexing structures to establish definite positions and orientations of the reference surfaces.

As far as particulars are concerned, the two cam means are circular and the shaft is also circular but off-center vis-a-vis the circular cam. The third cam may be configured differently in that it has a non-round configuration with different radii in different directions, thereby establishing this particular eccentricity. To facilitate fastening of the lever, there may be a particular collar of larger radius integral with and being structurally a part of this additional third cam. This particular feature is instrumental in providing, in addition, axial latching of the lever or handle.

As was mentioned earlier, the handle and the third cam have to have a definite relationship to the other cams. They could be all arranged in the same direction vis-a-vis the axes of the shaft so that the axes of maximum eccentricity of all of the three cam means are co-planar. However, it was found that a more linear arrangement, as far as the adjustment of the spacing between print head and platen is concerned, obtains if the lever or handle is in a 15 degree shift, as far as the other eccentrics are concerned. The lever will be moved from a null position to a print head retracting position because the null position must consider the minimum distance the print head must have from the platen.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 2:
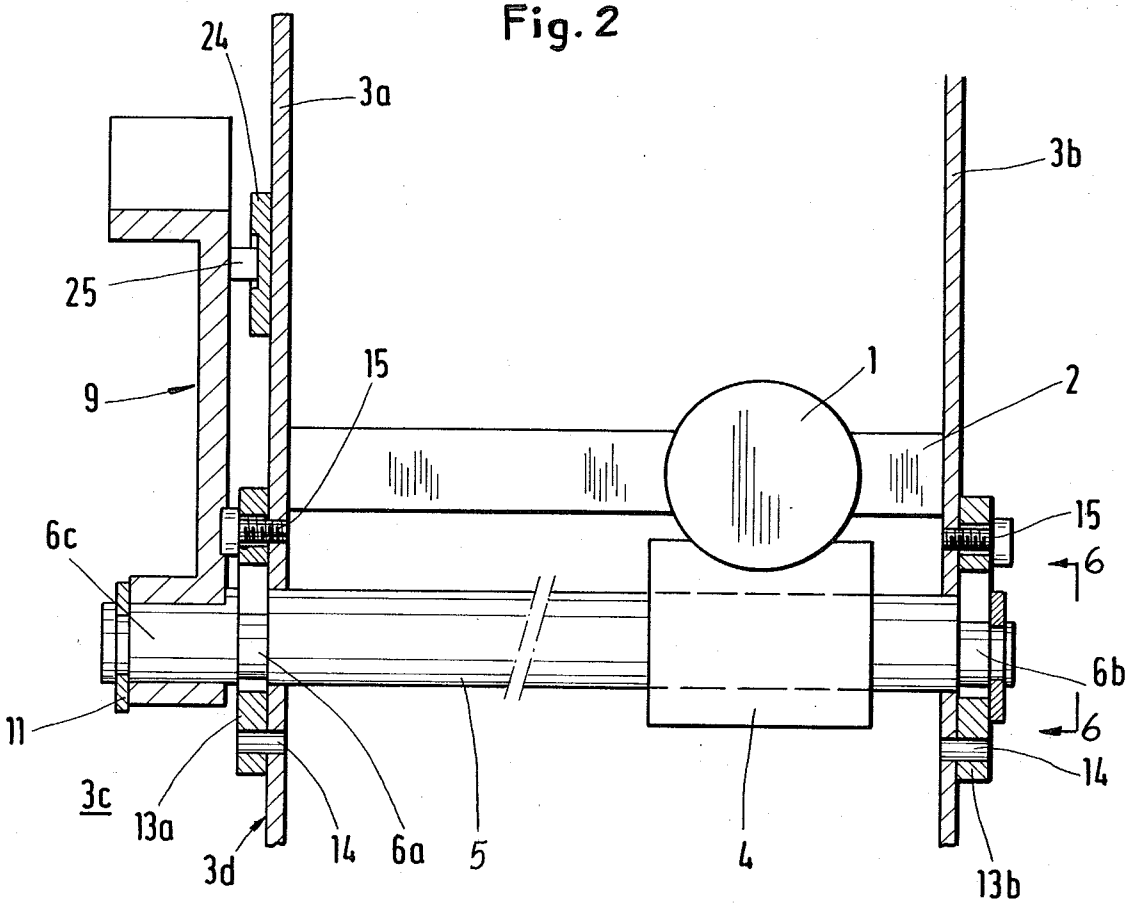
FIG. 2 is a somewhat simplified, but enlarged vertical section through the same matrix printer, as indicated by 2—2 in FIG. 1, the simplification involving illustration in that only those parts that are relevant for the invention are illustrated.
Figure 5:
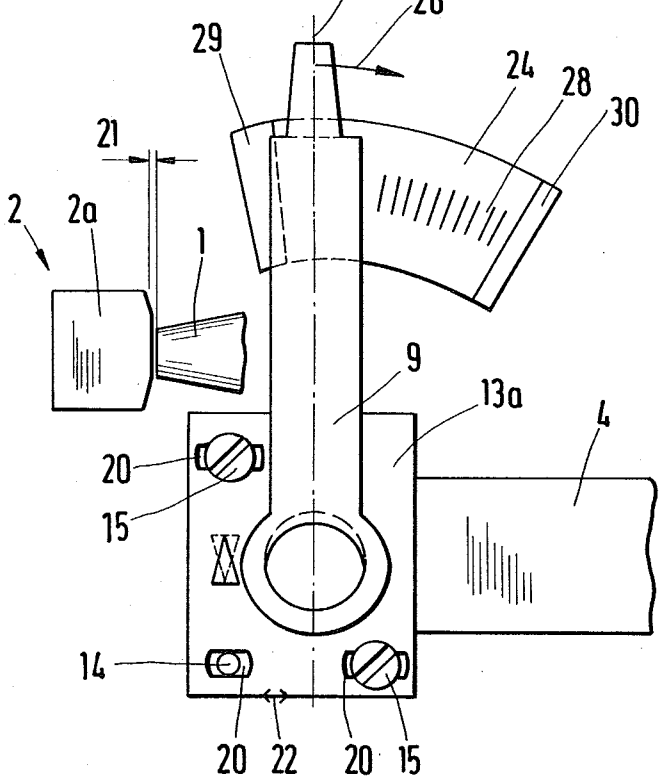
FIG. 5 is a side view of the print platen, of the print head and of the adjustment lever in accordance with the structure shown in FIGS. 1–4.

Proceeding to the detailed description of the drawings, a reference is made to the various figures which include a somewhat schematically shown print head 1 to be adjusted as to its distance from and in relation to a platen 2. It is assumed that the print head 1 is provided for matrix printing and containing print needles being suitably mounted and of conventional design. The printer is contained in a housing 3. To the right of the drawing is generally shown a paper advance structure 35 with pulleys and a belt drive 36, a single sheet feed channel 37 and an endless sheet feeder path 38 including a tractor device 39. Reference numeral 40 refers to the discharge and exit path for the sheet or sheets being printed on. Sheet feeding and paper advance is disclosed by way of example in co-pending applications of some of us (Ser. No. 21,454, filing date Mar. 4, 1987 and Ser. No. 21,453, filing date Mar. 4, 1987). The printing platen 2 can be provided as a cylindrical or drum-shaped platen as shown in FIG. 2 or as bar with a cross-section 2*a* as shown in FIG. 5.

Figure 1:
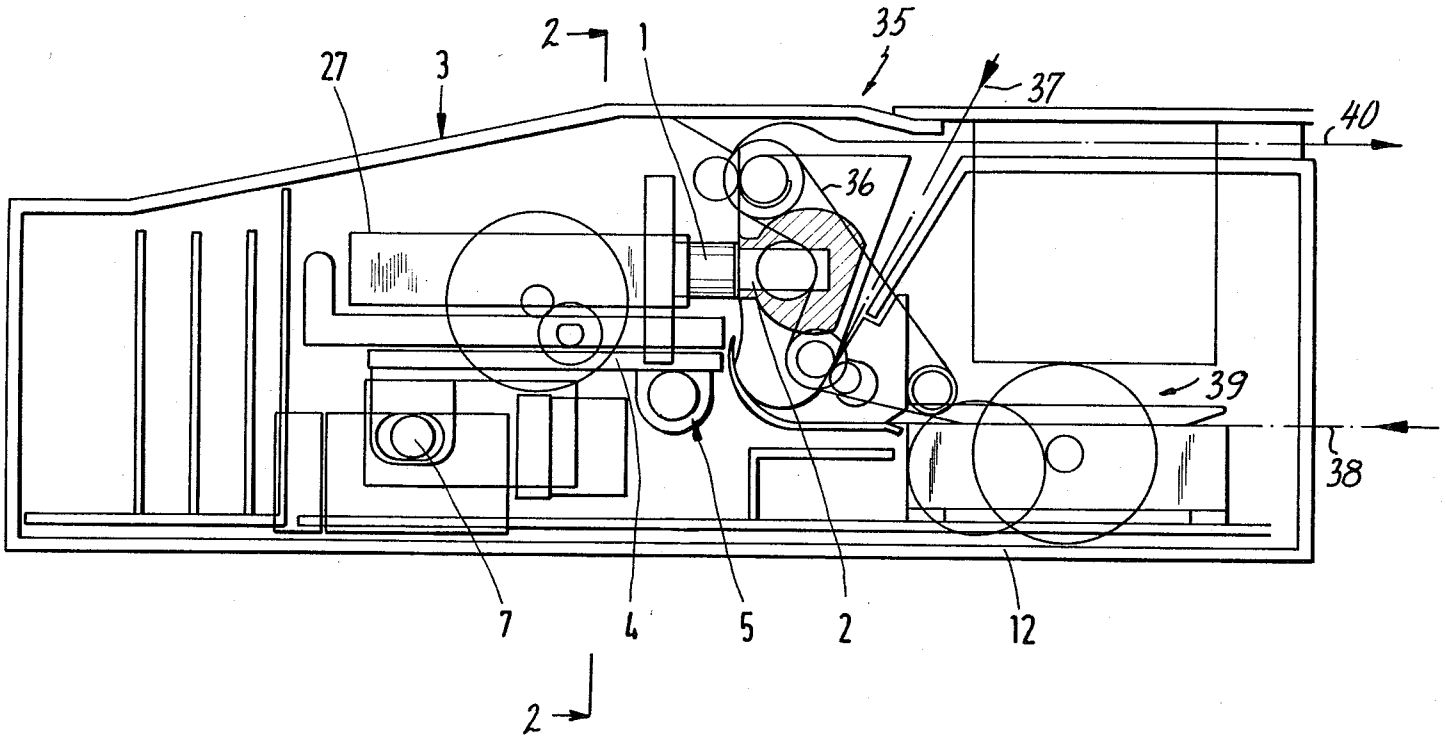
FIG. 1 is a vertical cross-section through a matrix printer equipped and constructed in accordance with the preferred embodiment of the present invention for practicing the best mode thereof.

The print head 1 is mounted on a carriage 4 and is secured thereto. The carriage 4 runs on a rail bar 5 and moves by means of a drive (not illustrated) transversely to the plane of the drawings of FIG. 1, that is parallel to the platen 2 with constant speed and in a reciprocating fashion. The rail bar 5 extends parallel to the platen 2. In addition, there is a second bar 7, running in a slot of carriage 4, and permits movement of the carriage in a direction transverse to the direction of movement on the rail bar 5, but still in a horizontal plane. Bar 7 is fixed to the printer housing but does not impede the reciprocating motion of the carriage 4 in the direction transverse to the plane of the drawing of FIG. 1.

Figure 6:
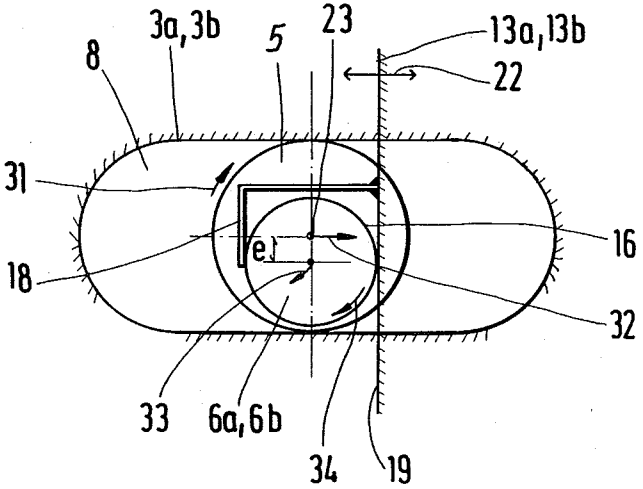
FIG. 6 is a side view of a side wall of a print frame with front view of the inserted shaft having the three eccenter elements shown in greater detail in FIGS. 3 and 4, the view being indicated by 6—6 in FIG. 2.

A horizontal displacement of the bar 5 itself varies the distance between the print head 1 and carriage 4, and the platen 2. Since the bar 7 is stationary, the slot 6 in the guide structure of carriage 4 permits a limited horizontal movement in the plane of the drawing of FIG. 1. The ends of shaft 5 are guided and held in side walls 3*a* and 3*b* of the print housing 3. There are horizontal recesses or slots, as shown in FIG. 6, to permit horizontal displacement of shaft or bar 5. These side walls extend parallel to the plane of the drawing in FIG. 1, respectively, below and above; the side walls are shown in FIG. 2. The shaft 5 carries at its end eccentric cam elements 6*a* and 6*b*. These cam elements are short drums of a smaller diameter than bar 5, and they are eccentric on the ends of that bar 5. The eccentricity e, as well as the relative phase angle of these elements, are the same for both cams.

A manually adjustable lever 9 is fastened to the outside 3*c* of printer housing 3. The zero or null position 9*a* of that lever 9 is shown in FIG. 5. Its angular orientation is in fixed alignment with the orientation of the eccentricity e of cams 6*a, b*. The lever 9 is held in a secure position on bar 5 by operation of a third eccentric cam 6*c*. The eccentricity e as well as the phase of that cam 6*c* are respectively identical with phase and eccentricity of cams 6*a* and 6*b*. Note that the phases do not have to be the same, as long as the angular relationship is fixed and definite. Zero phase angle between the cams 6*a,b* on one hand and 6*c* on the other hand is just convenient. Exact equality of eccentricity e, as well as the phase position, is obtained in that the shaft or bar 5 is, e.g. held during manufacture, and the eccentricity of the cams 6*a, b, c,* is positioned under utilization of convenient tools by means of which cams 6*a,* 6*b* and 6*c* are worked and mounted in the first place. The lever 9 is axially secured to cam 6*c* by means of spring rings 11 or otherwise (FIG. 2).

Horizontal slots 8 are provided in the side walls 3*a* and 3*b* of the printer frame 12. The ends of bar 5 can move in these indents in direction towards and away from the platen 2. Adjusting plates 13*a, b* face the walls 3*a, b,* respectively. These plates 13*a, b* are mounted on the outside 3*d* to provide for a partial cover of slots 8 under utilization of indexing pins 14 and fastening screws 15. This way, one positions and retains bar 5 in axial direction.

Figure 4:
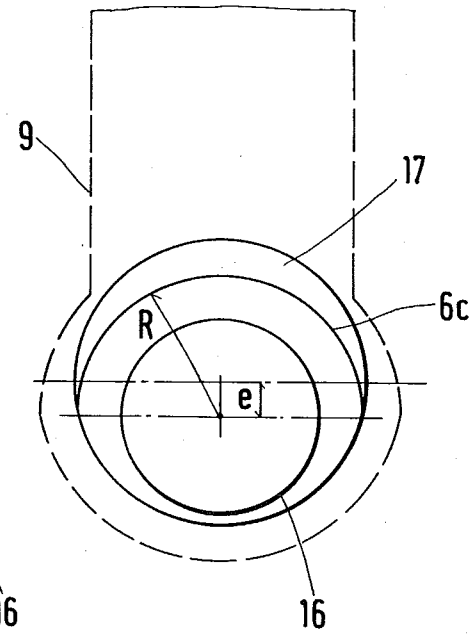
FIG. 4 is a front view of the shaft shown in FIG. 3.
Figure 3:
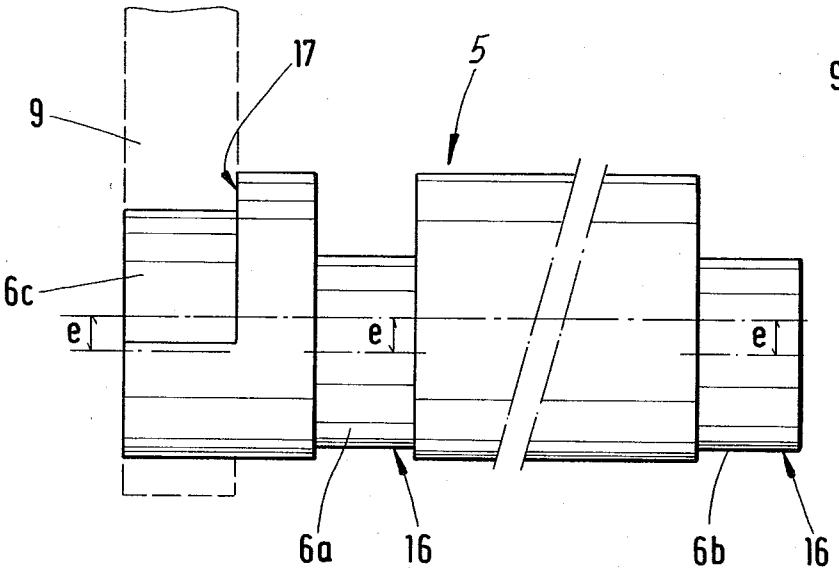
FIG. 3 illustrates the adjusting shaft with three eccentric cams in elevational view.

The eccentric cams 6*a,* and 6*b* are provided with circular cross-section while eccentric 6*c* is provided with the radius R, as shown in FIG. 4. One obtains here a radially larger collar portion 17 for this cam 6*c*. The eccenter cam 6*c* is obtained by a radius-reducing cut out, the roller 17 is in effect the residual in axial direction, and has the same dimensions as bar 5 itself (see FIG. 3).

As shown in FIG. 6, each of the eccentric elements 6*a* and 6*b* have their cylindrical surface 16 resiliently urged against a reference surface 19. This reference surface is shown schematically in FIG. 6, and pertains to the respective plates 13*a* or 13*b*, as the case may be. The resilient force is provided in each instance by an L-shaped spring 18. The two springs 18 are fastened in the interior of the adjusting plates 13*a* and 13*b*, respectively. The screws 15, as well as the indexing pins 14, run in oblong slots 20 in plates 13*a, b,* so that the entire system of eccenter cams 6*a, b, c* can be placed together in the position shown in FIG. 5. This way, one determines the position of the reference surfaces 19.

A minimum gap 21 is adjusted matching the stroke of the needles in the print head 1. This minimal gap 21 is usually in the order of 0.05 to 0.15 mm. The two plates 13*a* and 13*b* are then adjusted to be exactly parallel to each other such that the reference surface 19 of each of the plates 13*a* and 13*b* has exactly the same distance from the platen 2. The reference surfaces 19, moreover, are adjusted to be strictly co-planar to each other. The two springs 18 ensure permanent abutment of the cylindrical periphery 16 of cams 6*a* and 6*b* on the respective reference surfaces 19. The various adjusting directions are denoted by reference numeral 22 in FIGS. 5 and 6. On turning of lever 9, the three eccentric cams 6*a, b, c,* cause the drum-shaped bar 5 to move in that direction, as the springs 18 retain the cams 6*a, b* against these surfaces 19 of plates 13*a, b*.

In order to obtain a linear transverse positioned adjustment of bar 5, i.e. linear as much as possible, one should establish the null position 9*a* (FIG. 5) such that the eccentricity e is turned 15 degrees to the right in that figure about the axis 23 of shaft 5.

The basic aspect of the invention in this regard is to be seen in that the eccentric position (6*c*), in terms of angular orientation of that third supplemental eccentric cam 6*c*, on one hand, determines positively the position of lever 9. While, on the other hand, that eccentric has a definite (low tolerance) angular orientation to the eccentric cam 6*a* and 6*b*. Therefore, the position of that lever 9 is a visual indication and a tool for adjustment of the distance between the print head from the platen, bearing in mind that owing to a calibration procedure to be described next, any adjustment position, including any angular deflection of the lever 9, is referred to a well defined null position based on the minimum gap 21 as identified above.

The lever 9 is, thus, for instance, arranged in the position as shown in FIG. 5. The position 9*a* of lever 9, shown in FIG. 5, is a particular zero position 9*a*. Here one establishes a minimal gap 21 in the stated range.

A curved latching segment 24 faces the lever 9. In particular a latching nose 25 of the segment faces the lever. Lever 9, therefore, can be pivoted in the direction 26. Upon pivoting lever 9 over the full angle range permitted the distance between the platen and the head 1, is drastically increased. This may be necessary for instance for exchanging the ribbon cartridge 27. In this open position latching nose 26 enters a gear-like gap 28 on segment 24. This position of latching holds the head and the carriage relatively far away from the platen. The path of lever 9 is limited by the stops 29 and 30 being also provided on the segment 24.

The retraction of the head 1, as outlined above, corresponds to a turning of the bar 5 about its axis 23 in a direction 31. This occurs on pivoting lever 9 in the direction 26. Still in the same manner this adjusting motion causes a horizontal transverse movement of the bar 5 in direction 32, whereby the center of cams 6*a* and 6*b* pivot in direction 33 and actually rotate in direction 34, while remaining in abutment with surfaces 19 by operation of the springs 18. This way, one reduces the distance between the axis 23 of bar 5 and the reference surface 19, which reduction is understood as part of the previous described head opening (retraction) movement. Consequently, the distance between the head 1 from the platen 2 is increased.

The invention is not limited to the embodiments described above but all changes and modifications thereof, not constituting departures from the spirit and scope of the invention, are intended to be included.

We claim:

1. Device for adjusting the spacing between a print head mounted on a carriage riding on a rail means, and a print platen along which the print head travels, there being a printer frame in which the platen is mounted, the frame having two side walls structures comprising:

the rail means including a round bar traversing the carriage and causing the carriage to move towards and away from the platen as the shaft moves in a direction transversely to its extension, the bar being held in slots in the side wall structure permitting this movement;

first and second eccentric cam means on opposite ends of the bar having similarly oriented eccentricities;

two adjustably positioned plate means on the side wall structure each having a reference surface;

spring means for urging the first and second eccentric cam means respectively against the reference surfaces of the plate means;

a third eccentric cam means on the bar having an eccentricity that is particularly oriented to the first and second eccenter cam means; and a latching handle means on the third eccentric cam means such that the angular disposition of the handle means is a precise indication of the position of the first and second cam means and, thereby, of the spacing of the bar from the plate.

2. Device as in claim 1, there being latch means for latching the handle means in one of a plurality of positions.

3. Device as in claim 1, there being fastening means for the plate means on the side wall means as well as indexing means for adjustably mounting the plate means to the side wall to thereby adjust the reference surfaces.

4. Device as in claim 1, the first and second cam means being circular, the bar having also circular cross-section, but off center vis-a-vis the circular cam means.

5. Device for adjusting the spacing between a print head mounted on a carriage riding on a rail means, and a print platen along which the print head travels, there being a printer frame in which the platen is mounted, the frame having two side walls structures comprising:

the rail means including a round bar traversing the carriage and causing the carriage to move towards and away from the platen as the shaft moves in a direction transversely to its extension, the bar being held in slots in the side wall structure permitting this movement;

first and second short drums eccentrically connected to opposite ends of the round bars, the short drums being coaxial to each other;

two plate means adjustably affixed to the two side walls, the first and second drums, respectively, abutting reference surfaces of the plate means, said reference surfaces being coplanar to each other;

spring means for holding the first and second drums in abutment with the reference surfaces of said plate means;

lever means mounted to said bar coaxially with said first and second drums and thus eccentric to said bar; and latching means for latching the lever means in different positions including a particularly identified null position wherein the bar has a minimum distance from the platen.

* * * * *